US005184729A

United States Patent [19]

Zalenski

[11] Patent Number: 5,184,729

[45] Date of Patent: Feb. 9, 1993

[54] NEEDLEWORK THREADHOLDER AND ORGANIZER

[76] Inventor: Roberta M. Zalenski, 13630 Runney Meade Dr., Sugar Land, Tex. 77478

[21] Appl. No.: 873,808

[22] Filed: Apr. 27, 1992

[51] Int. Cl.[5] ..... B65D 69/00; A41H 31/00

[52] U.S. Cl. ..... 206/574; 223/107; 223/109 R; 206/459.5; 206/383

[58] Field of Search ..... 206/574, 380, 382, 383, 206/459.5; 223/106, 107, 108, 109 R; 434/95

[56] References Cited

U.S. PATENT DOCUMENTS

| | | | |
|---|---|---|---|
| Re. 16,509 | 12/1926 | Burkholder | 206/574 X |
| 890,486 | 6/1908 | Anderson | 223/107 |
| 1,331,236 | 2/1920 | Brooks et al. | 223/107 |
| 2,831,572 | 4/1958 | Messina | 206/382 |
| 4,264,011 | 4/1981 | Dalbo et al. | 206/574 |
| 4,310,313 | 1/1982 | Brundige | 206/574 |
| 4,319,703 | 3/1982 | Gann | 223/109 R |
| 4,478,333 | 10/1984 | Dalbo et al. | 223/109 R |
| 4,561,574 | 12/1985 | Brown | 223/109 R |
| 4,664,302 | 5/1987 | Dalbo et al. | 206/574 X |

*Primary Examiner*—William I. Price
*Attorney, Agent, or Firm*—Keeling & Associates

[57] ABSTRACT

A storage case and organizing insert for needlecraft material and accessories is disclosed. The organizer and storage case comprises a box-like container together with a replaceable organizer insert removably contained within the container.

The removable organizer insert comprises a generally rectangular member constructed of a material which is easily penetrable by sewing needles. The top and bottom surfaces of the organizer insert are overlaid with material which is also easily penetrable by a needle. An organizational grid is provided on the material overlaying each of the top and bottom surfaces of the organizer insert.

The organizational grids are provided with various rectangular spaces to serve as guides for locating the threaded needles and further provided with smaller areas for entering identification information such as thread numbers or symbols.

The organizer insert may be removed with threaded needles attached for storage elsewhere or for replacement with another organizer insert for use on the current project.

10 Claims, 1 Drawing Sheet

FIG. 1
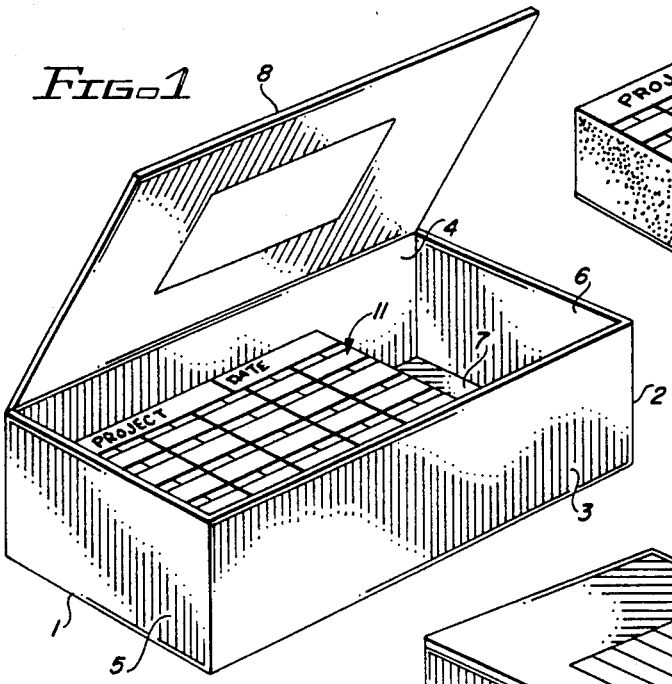
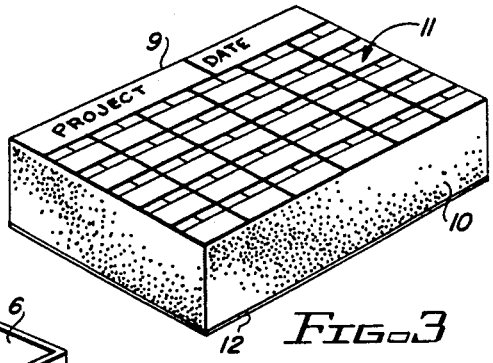
FIG. 3
FIG. 2
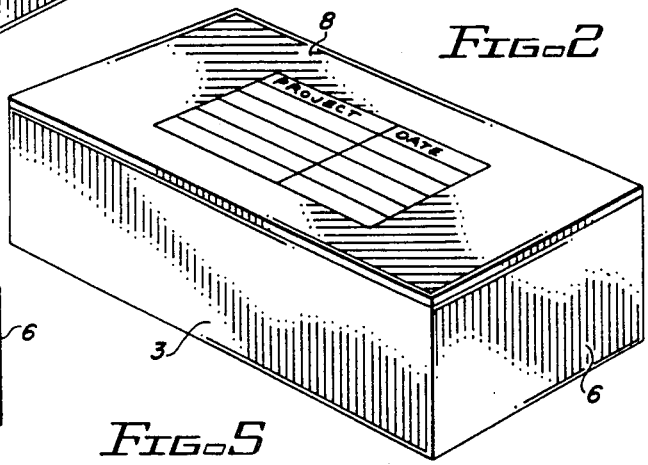
FIG. 4
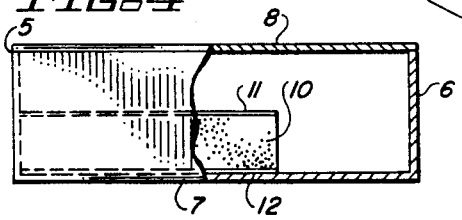
FIG. 5
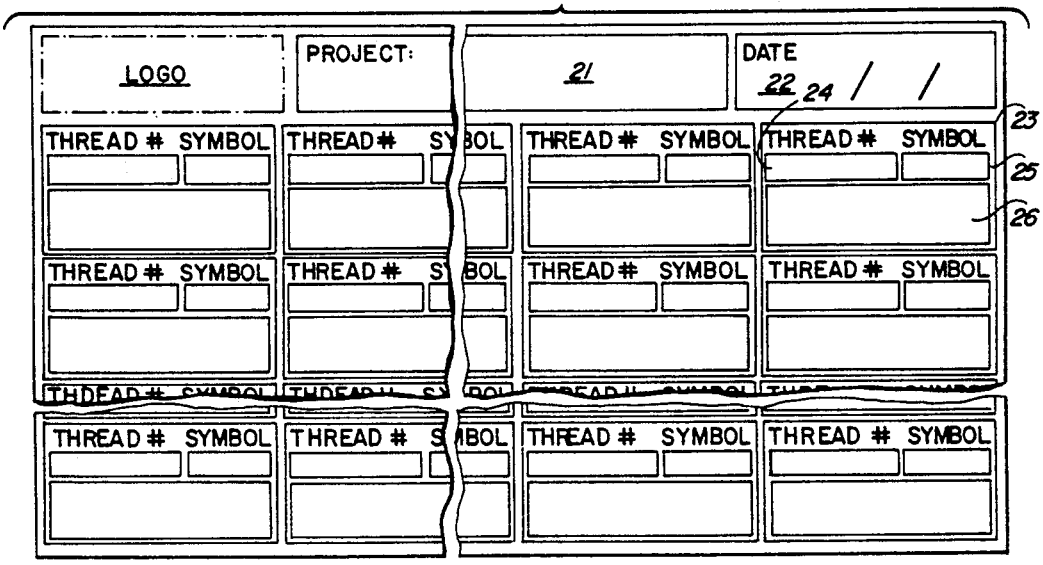

NEEDLEWORK THREADHOLDER AND ORGANIZER

BACKGROUND OF THE INVENTION

This invention pertains generally to needlework and needlecraft threadholders and organizers and in particular to a device which holds and organizes numerous sewing needles which have been previously threaded and prepared according to the instructions and patterns for a given needlecraft project.

Needlecraft projects require that sewing needles be threaded with various colors of thread according to the requirement of each particular project. The number of different needles which will need to be prepared will depend upon the requirements of each project. The needles that are prepared for each project may remain threaded with a particular color and type thread after its use on the project or they may be rethreaded with another color or type of thread for use on the same project. Additionally, needles which are threaded with a type or color of thread which is commonly used in many needlecraft projects may be used again without the necessity of rethreading them on subsequent projects.

As the number of needles and associated numbers and types of thread increase on projects as called for in project patterns, a major concern becomes the manner in which the materials are stored and organized. Storage of the materials in an unorganized manner can result in the loss of time and material due to the materials becoming entangled, damaged and sometimes being rendered unusable.

The needlework threadholder and organizer of the present invention provides a substantial improvement over existing threadholders and organizers by allowing sewing needles which have been threaded for use on a needlecraft project to remain threaded for the duration of the project. The threadholder and organizer of the present invention functions as a tool during the activity of the project and as a storage device for the periods of time when the project tasks are not being performed. The present device allows the participant in the needlecraft project to immediately resume the project after a period of inactivity without the necessity of threading needles, reorganization or becoming familiar with the requirement of the project. Often times, publishers of needlecraft patterns call for the repeated use of particular combination of threads in subsequent patterns. The device of the present invention allows the needle and thread combinations required for the needlecraft project to be stored in a manner where they will be immediately identifiable, accessible and usable by the participant of the project.

Gann U.S. Pat. No. 4,319,703, discloses a ring binder with clear opaque sheets of plastic mounted in the binder. Each of the clear opaque plastic sheets contain pockets for the storage of yarn or thread of various colors for use in needlecraft projects.

Dalbo et al., U.S. Pat. No. 4,478,333 discloses a device for storage of needlecraft materials and accessories which is of a foldable nature and consists three main storage sections. This device contains numerous pockets in each of the sections for the storage and easy retrieval of needlecraft material and accessories.

The foregoing patents and current commercial practice do not teach the use of a storage and organizational container as a tool and aid with which to enhance the performance of needlecraft work and projects as is disclosed in the present invention. Due to the organizational assistance offered by the present invention, its utility far exceeds that of any prior art.

It is therefore a purpose of the present invention to provide a device of inexpensive construction for the storage, identification, organization, transportation, and usage of needlecraft materials and accessories.

It is a further purpose of the present invention to provide a device for the storage, identification, organization, transportation, and usage of needlecraft materials and accessories which allows for a plurality of threaded needles to be simultaneously positioned and organized for viewing and use according to project, thread color, thread type, and project symbol.

It is a further purpose of the present invention to provide an improved method of storing, identifying organizing, transporting and using needlecraft materials and accessories and resulting function as a tool and aide in the performance of the needlework.

SUMMARY OF THE INVENTION

A storage case and organizing insert for needlecraft material and accessories is disclosed. The organizer and storage case comprises a box-like container together with a replaceable organizer insert removably contained within the container.

The removable organizer insert comprises a generally rectangular member constructed of a material which is easily penetrable by sewing needles. The top and bottom surfaces of the organizer insert are overlaid with material which is also easily penetrable by a needle. An organizational grid is provided on the material overlaying each of the top and bottom surfaces of the organizer insert.

The organizational grids are provided with various rectangular spaces to serve as guides for locating the threaded needles and further provided with smaller areas for entering identification information such as thread numbers or symbols.

The organizer insert may be removed with threaded needles attached for storage elsewhere or for replacement with another organizer insert for use on current project. The pre-threaded needles for each project are stored by pressing them through the printed organizational grid into the underlying media within the gridsquare. The organizational grid may be labeled to denote the thread and symbol used within the needlecraft project.

BRIEF DESCRIPTION OF THE DRAWINGS

FIG. 1 illustrates an isometric view of the needlework threadholder and organizer of the present invention with the cover open.

FIG. 2 illustrates an isometric view of the needlework threadholder and organizer of the present invention with the cover closed.

FIG. 3 illustrates the organizational grid insert.

FIG. 4 illustrates a cut-away view of the needlework threadholder and organizer showing the organizational grid insert located within the needlework threadholder and organizer.

FIG. 5 illustrates a top view of the organizational grid insert.

DESCRIPTION OF THE PREFERRED EMBODIMENT

Referring first to FIG. 1, an isometric view of the storage case and organizer insert 1 of the present invention is depicted. The storage case 2 comprises a box-shaped container comprised of generally rectangular end wall 5 and 6, generally rectangular front wall 3 and back wall 4, and generally rectangular bottom 7 and lid 8.

The height and width of end wall 5 are equivalent to the height and width of end wall 6. In like manner, the height and width of front wall 3 are equivalent to the height and width of back wall 4.

Lid 8 is rotably attached to the upper edge of back wall 4, attachment may be by means of hinges (not shown) or other suitable means of attachment. Lid 8 may be rotated about the attaching edge to open and shut the storage case 2.

Referring to FIG. 3, the organizer insert 9 of the present invention comprises a generally rectangular block 10 overlaid on its upper surface by a overlay 11. The overlay 11 is imprinted with a series of rectangular grids, each rectangular grid having further subdivisions imprinted therein. Block 10 is constructed of styrofoam in the preferred embodiment, but may be constructed of other materials easily penetrable by a needle point. Overlay 11 is constructed of paper in the preferred embodiment, but may be constructed of any material readily penetrable by needlepoint and providing a suitable writing surface such as cardboard, vellum, plastic or bond paper.

Overlay 11 is glued to block 10.

In like manner, an overlay 12 is attached to the bottom surface of block 10. Overlay 12 is also imprinted with a series of rectangular grids (not shown), each rectangular grid having further subdivisions imprinted therein (not shown).

Referring to FIG. 1 and FIG. 4, the block 10 is constructed with a width equivalent to the distance between front wall 3 and back wall 4 of storage case 2 so that block 4 fits snugly between front wall 3 and back wall 4 when the organizer insert 9 is placed within storage case 2.

The height of block 10 is substantially less than the distance between bottom 7 and lid 8 of storage case 2, thereby providing an open space within the storage case 2 above the organizer insert 9 after insertion of organizer 9 in storage case 2. In like manner, the length of block 10 is substantially less than the distance between end wall 5 and end wall 6, providing an open space between organizer insert 9 and end wall 6. The open spaces provided above organizer insert 9 and between organizer insert 9 and end wall 6 allow for the storage of needlecraft materials and accessories within storage case 2. In the preferred embodiment the open space provided above and at the end of organizer insert 9 is sufficient to comfortably hold sufficient spools of thread, materials, and accessories for a needlepoint project.

Overlays 11 and 12 are each imprinted with sufficient indicia to define grids to enable organization of various threaded needles. Referring to FIG. 5, the preferred embodiment of the grid structure of overlay 11 and overlay 12 comprises a rectangular section 21 for identification of the project, a rectangular section 22 for insertion of the date, and a plurality of rectangular sections 23, each rectangular section 23 containing subdivided section 24 for providing identifying information as to thread number, symbols, and subdivided section 26 wherein a threaded needle may be inserted.

OPERATION

During the course of a needlework project, and according to the patterns provided in each project, certain types and colors of thread are designated for use. The various threads may be identified by number or symbol, or both. Upon threading a needle with a particular type of thread, the threaded needle (not shown) may be inserted into a subdivided section 25 of organizational grid 20 and identifying information as to thread number or symbol entered into subdivided section 23 and 24. The threaded needle is inserted by pressing the needle point through the overlay 11 or overlay 12 into the underlying block 10 with the eye of the needle and the thread extending outwardly from the organizing insert 9.

The organizing insert 9 may be removed from the storage case 2 during needlecraft operation, or may be left in storage case 2 throughout.

Upon use of the grids 23 contained on overlay 11 the organizing insert may be turned over and the organizing grids 23 on overlay 12 may be utilized.

Upon full utilization of the organizing grid 23 of overlays 11 and 12, the organizing insert 9 may be replaced. If the user works on a number of projects during a time period, a series of organizing inserts 9 may be used with the organizing inserts 9 not currently in use stored in another location.

In an alternative embodiment, overlay 11 and overlay 12 may be removably attached to block 10 to allow replacement of overlay 11 and overlay 12 without replacing block 10.

Variations may be made from the preferred embodiment herein disclosed without departing from the scope thereof as defined by the appended claims.

I claim:

1. A storage case and needlework organizing insert for needlecraft materials and accessories comprising:

a generally box-shaped storage container;

an organizing insert removably inserted in the said storage container;

the said organizing insert being constructed of a material readily impregnable by the point of a sewing needle;

the said organizing insert being imprinted on at least one surface with subdivided sections.

2. The storage case and needlework organizing insert of claim 1, wherein the organizing insert comprises a generally rectangular block.

3. The storage case and needlework organizing insert of claim 2 wherein;

the organizing insert is of sufficient width so as to snugly fit between two opposing sides of the container.

4. The storage case and needlework organizing insert of claim 2 wherein;

the height and length of the organizing insert are significantly less than the height and length of the container providing an open space within the container after insertion of the organizing insert within the container.

5. The storage case and needlework organizing insert of claim 2 wherein;

an overlay is attached to at least one surface of the organizing insert, said overlay being provided with a plurality of subdivided sections.

6. The storage case and needlework organizing insert of claim 5 wherein;

the overlay is removably attached to the organizing insert.

7. A storage case and needlework organizing insert for needlecraft materials and accessories comprising:

a generally box-shaped storage container;

an organizing insert removably inserted in the said storage container;

the said organizing insert being constructed of a material readily impregnable by the point of a sewing needle;

the said organizing insert being imprinted on at least one surface with subdivided sections;

the organizing insert comprises a generally rectangular block;

the organizing insert being of sufficient width so as to snugly fit between two opposing sides of the container;

the height and length of the organizing insert are significantly less than the height and length of the container providing an open space within the container after insertion of the organizing insert within the container.

8. The storage case and needlework organizing insert of claim 7 wherein;

an overlay is attached to at least one surface of the organizing insert, said overlay being provided with a plurality of subdivided sections.

9. The storage case and needlework organizing insert of claim 7 wherein;

the overlay is removably attached to the organizing insert.

10. A storage case and needlework organizing insert for needlecraft materials and accessories comprising:

a generally box-shaped storage container;

an organizing insert removably inserted in the said storage container;

the said organizing insert being constructed of a material readily impregnable by the point of a sewing needle;

the said organizing insert being imprinted on at least one surface with subdivided sections;

the organizing insert comprises a generally rectangular block;

the organizing insert being of sufficient width so as to snugly fit between two opposing sides of the container;

the height and length of the organizing insert are significantly less than the height and length of the container providing an open space within the container after insertion of the organizing insert within the container;

an overlay is attached to at least one surface of the organizing insert, said overlay being provided with a plurality of subdivided sections;

the overlay is removably attached to the organizing insert.

* * * * *